US010651631B2

(12) United States Patent
Merke et al.

(10) Patent No.: US 10,651,631 B2
(45) Date of Patent: May 12, 2020

(54) SPARK PLUG WITH POLYMER SEALING RING

(71) Applicant: Federal-Mogul Ignition GmbH, Neuhaus-Schierschnitz (DE)

(72) Inventors: Malik Merke, Essen (DE); John Burrows, Manchester (GB)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/507,631

(22) Filed: Jul. 10, 2019

(65) Prior Publication Data

US 2020/0028334 A1 Jan. 23, 2020

(30) Foreign Application Priority Data

Jul. 17, 2018 (DE) ..... 10 2018 117 212

(51) Int. Cl.
*H01T 13/36* (2006.01)

(52) U.S. Cl.
CPC ..... *H01T 13/36* (2013.01)

(58) Field of Classification Search
CPC ..... H01T 13/36
See application file for complete search history.

(56) References Cited

U.S. PATENT DOCUMENTS

| | | | |
|---|---|---|---|
| 8,186,160 | B2 | 5/2012 | Anthony |
| 8,555,860 | B2 | 10/2013 | McAlister |
| 9,000,087 | B2 | 4/2015 | El-Hibri et al. |
| 2011/0247583 | A1 | 10/2011 | Shkolnik et al. |
| 2015/0330240 | A1 | 11/2015 | Kelly et al. |
| 2016/0304716 | A1 | 10/2016 | Gopalakrishnan et al. |
| 2017/0022895 | A1 | 1/2017 | Balling et al. |
| 2017/0030468 | A1 | 2/2017 | Badrossamay et al. |
| 2017/0184201 | A1 | 6/2017 | Gorol et al. |

FOREIGN PATENT DOCUMENTS

| | | | |
|---|---|---|---|
| DE | 10359573 | A1 | 7/2005 |
| DE | 102016219636 | A1 | 4/2018 |
| EP | 2899230 | A1 | 7/2015 |
| EP | 2899232 | A1 | 7/2015 |
| GB | 2530699 | B | 9/2016 |
| WO | 2011025512 | A1 | 3/2011 |
| WO | 2011028223 | A2 | 3/2011 |
| WO | 2011028225 | A1 | 3/2011 |
| WO | 2015090723 | A1 | 6/2015 |
| WO | 2016184904 | A1 | 11/2016 |
| WO | 2017046599 | A1 | 3/2017 |

OTHER PUBLICATIONS

Office Action issued for the German Application No. 10 2018 117 212.5 dated Mar. 21, 2019.

*Primary Examiner* — Joseph L Williams
(74) *Attorney, Agent, or Firm* — Reising Ethington, P.C.

(57) ABSTRACT

A spark plug is specified, having a metal shell with an axial bore and a threaded section, having an insulator with an axial bore that is located at least partially inside the axial bore of the metal shell; a center electrode that is accommodated at least partially inside the axial bore of the insulator; a ground electrode that is held by the metal shell, wherein an end region of the ground electrode forms, together with the center electrode, an ignition gap, and having a sealing ring that extends at least between an outside shoulder of the insulator and an inside shoulder of the metal shell, wherein the sealing ring has polyaryl ether ketone (PAEK), preferably polyether ether ketone (PEEK).

20 Claims, 4 Drawing Sheets

SPARK PLUG WITH POLYMER SEALING RING

This application claims the benefit of German Application No. 10 2018 117 212.5, filed on Jul. 17, 2018, the contents of which are hereby incorporated by reference in their entirety.

FIELD

The present invention relates to spark plugs in general, and in particular to spark plugs having an improved inner sealing ring for increasing the dielectric strength, wherein the spark plug is designed for internal combustion engines in particular.

BACKGROUND

Spark plugs are used to initiate combustion in internal combustion engines. Spark plugs typically ignite a gas such as, for instance, an air/fuel mixture in a combustion chamber or combustion space by producing a spark over a spark gap that is defined by two or more spark plug electrodes. The igniting of the gas by means of the spark produces a combustion reaction, which in turn drives a piston inside an engine cylinder during a power stroke of the combustion process.

In modern spark plugs, seals are used at different locations in the spark plug so that the spark plug installed in the cylinder head or engine or spark plug hole is gastight with respect to the gases located in the combustion chamber. In addition to an outer seal for sealing the spark plug housing with respect to the cylinder head or engine, there is at least one inside seal, also called inner sealing washer or inner gasket, which seals the transition between the metal shell, in which the thread is accommodated, and the insulator that surrounds the center electrode.

Because of the specific requirements on an inside seal, such as, for example, temperature resistance, thermal conductivity, and plastic deformability, until now metal seals have been used, which are made, in particular, of aluminum alloys, copper alloys, or steel alloys.

It has become apparent, however, that in the case of metallic inside seals, undesirable voltage flashovers between the metal shell and the center electrode located in the insulator sometimes occur in the region of the inside seal. Such undesirable voltage flashovers lead to misfires in the combustion chamber, since the electrical energy is dissipated in the interior of the spark plug. The spark plug is damaged. This has the consequence that no ignition spark is produced in the spark gap (between the center electrode and ground electrode). The energy for ignition of the fuel/air mixture is not made available at the spark gap.

Such undesirable flashovers occur in prior art spark plugs because the metallic inside seal is at the same electric potential as the metal shell, and consequently reduces the effective distance between the metal shell and the center electrode, which are at different levels of electric potential. Also, for manufacturing reasons the metallic inside seals can have edges at which local increases in the electric field can occur. The field increase can extend into the insulator, and raises its electrical demands, reducing the electrical strength of the spark plug.

While the dielectric strength of the insulator can indeed be influenced by the choice of material, which is to say the choice of the applicable ceramic, there are nonetheless material related limits in this regard. Typical dielectric strengths of insulators used in spark plugs they are generally made of aluminum oxide are on the order of 19 kV/mm.

In order to increase the dielectric strength of a spark plug, it would thus be desirable to produce the sealing ring of the inside seal from a material with high dielectric strength.

From WO 2015/090,723 A1, a spark plug is known with a sealing ring for the inside seal that is made entirely of nonconductive material. Two inside seals are used in this design: a first inside seal in the region of the end on the combustion chamber side of the transition between the metal shell and the insulator, in particular in the region of the neck of the insulator nose, as well as a second seal in the region of the end of the metal shell facing away from the combustion chamber.

The sealing rings in question are made of a polymer or an oxide ceramic material, such as strontium titanate, for example.

While oxide ceramics have the disadvantage that they are not plastically deformable and a seal with them can therefore be achieved only with difficulty, polymers have the disadvantage that they frequently are not sufficiently temperature resistant. Even though polymers also exist that are temperature resistant up to 300° C. and above, they usually do not have adequate thermal conductivity.

Otherwise, it is not possible to learn from this publication which polymer is supposed to be suitable for the sealing ring in question.

It is therefore desirable to provide a spark plug with an increased dielectric strength.

It is also desirable to disclose a spark plug with a long service life.

SUMMARY

Against this background, it is an object to specify an improved spark plug with a high dielectric strength, which preferably also has as great a long-term durability as possible.

This object is attained by a spark plug having:

a metal shell with an axial bore and a threaded section;

an insulator with an axial bore that is located at least partially inside the axial bore of the metal shell;

a center electrode that is accommodated at least partially inside the axial bore of the insulator;

a ground electrode that is held by the metal shell, wherein an end region of the ground electrode forms, together with an end region of the center electrode, an ignition gap, and a sealing ring that extends at least between an outside shoulder of the insulator and an inside shoulder of the metal shell, wherein the sealing ring has polyaryl ether ketone (PAEK).

The object is attained in full in this way.

Preferred embodiments of the spark plug are placed under protection in the dependent claims.

With the spark plug according to the illustrated and described embodiments, increased dielectric strength can be achieved. It has become apparent that PAEK has adequate temperature resistance, being on the order of approximately 300° or higher. Moreover, this material can be manufactured with a relatively high thermal conductivity so that the thermal load in the vicinity of the sealing ring remains sufficiently low.

According to one or more embodiments, a higher dielectric strength of the spark plug is produced by reducing the existing electric field between the center electrode and the metal body in the region of the seal seat, since the dielectric strength of the plastic material used is equal to or greater than that of the insulator material. Because of the reduced electric capacitance of the electrical conductor with respect to ground, the required ignition voltage at the ignition gap is reduced, which reduces electrode wear on account of the lower ignition voltage.

Furthermore, an improved bending strength in the region of the ceramic insulator (toward the center electrode tip) is produced due to a reduced preloading, since the friction in the region of the sealing ring resulting from the use of a plastic material is reduced in comparison with a metallic seal.

According to another embodiment, the sealing ring has polyether ether ketone (PEEK).

It has become apparent that this material is especially suitable for producing the sealing ring.

According to another embodiment, the sealing ring extends at least in a gap that is formed between the outside shoulder of the insulator and the inside shoulder of the metal shell.

A secure seal is ensured in this way.

According to another embodiment, the sealing ring extends at least partially beyond the gap in a direction distant from the end region of the center electrode.

In this way, the sealing effect can be improved still further. Even if a minimal flow of the material that the sealing ring is made of should occur during the service life of the spark plug, a secure seal is ensured nevertheless.

According to another embodiment, the sealing ring additionally has a filler. Preferably, boron nitride is used as filler. In this context, 5 to 80 percent by volume, preferably 10 to 70 percent by volume, especially preferably 20 to 60 percent by volume boron nitride can be provided, in particular.

Due to the addition of boron nitride as filler, the thermal conductivity is improved. As a result, the thermal stress on the sealing ring is reduced, and a reliable heat transfer from the insulator to the metal body is ensured.

According to another embodiment, the sealing ring has glass fibers and/or carbon fibers as filler.

In this context, preferably 0 to 30 percent by volume, preferably 1 to 30 percent by volume, further preferred 3 to 25 percent by volume, especially preferably 3 to 20 percent by volume glass fibers and/or carbon fibers can be provided.

Due to the addition of glass fibers and/or carbon fibers, the mechanical strength of the base material is improved.

According to another embodiment, the sealing ring has a thermal conductivity of at least 3 $Wm^{-1}K^{-1}$, preferably at least 3.5 $Wm^{-1}K^{-1}$, further preferably at least 4 $Wm^{-1}K^{-1}$.

High thermal conductivities of this nature can be achieved, for example, through corresponding additions of boron nitride. Especially low thermal stresses result in this way.

According to another embodiment, the sealing ring has a dielectric strength of at least 16 kV/mm, preferably at least 18 kV/mm, further preferred at least 19 kV/mm, especially preferably at least 20 kV/mm.

By this means, in conjunction with an appropriately high dielectric strength of the ceramic insulator, the dielectric strength of the spark plug can be increased.

It is a matter of course that the features cited above and those explained below can be used not only in the combinations stated in each case, but also in other combinations or alone, without departing from the scope of the present invention.

DRAWINGS

An example embodiment is shown in the drawings, and is explained in detail in the description below. Shown are:

FIG. 1 a schematic representation of a spark plug according to one embodiment in a partially sectional longitudinal view;

FIGS. 2, 3 an electric field analysis by means of FEA (finite element analysis) with the application of a voltage of 1 V to the center electrode with a standard metal seal and a sealing ring according to the invention made of PEEK with a dielectric strength of 23 kV/mm;

FIG. 4 the component temperatures determined by means of FEA analysis using a sealing ring according to the invention with an outer ring seal temperature of 110° C., a cylinder cooling temperature of 125° C., and with a heat flux of an inner surface of the cylinder at a specific power output of 110 kW/l;

FIG. 5 the resulting temperatures for a standard spark plug with a polymer sealing ring according to the invention made of PEEK with a thermal conductivity of 4 $Wm^{-1}K^{-1}$ under full load conditions; and FIG. 6 the resulting temperatures in the vicinity of the sealing ring.

DESCRIPTION

FIG. 1 shows the basic structure of a spark plug according to one embodiment of the invention, which is labeled overall with the number 10.

The spark plug 10 has, essentially, a metal shell 12 with an external thread 14, an insulator 22 which is accommodated partially inside the metal shell 12 and inside which is provided a center electrode 24. The center electrode 24 is sealed with respect to the insulator 22 by a glass seal 25, which can also be implemented as a "panat" resistance, in order to ensure sealing with respect to the combustion chamber.

An end section 28 of the center electrode 24 projects out of the insulator 22, and, together with an end section 33 of a ground electrode 32 that protrudes from the threaded section 14, forms an ignition gap 30.

At the outer end, the spark plug 10 has a high-voltage terminal 26 through which the ignition voltage is supplied via a suitable spark plug connector.

The metal shell 12 has, on its outer end facing away from the ground electrode 32, a section 40 in the shape of a polygon for application of a spark plug wrench. Adjacent to the section 40 at a certain distance in the direction of the threaded section 14 is a shoulder 18. Accommodated on the section 18 is an outside seal 20.

The metal shell 12 has an axial bore 16, which surrounds a section of the insulator 22 on the combustion chamber side. The insulator 22 is typically made of a ceramic material, such as aluminum oxide, for instance. The outside seal ring 20 can be made of metal, for example copper, and if applicable can also be combined with another sealing element.

It is a matter of course that any desired combinations and materials are possible.

The metal shell 12 represents an external structure or a housing for the spark plug 10, and includes the threaded section 14 for installation in a cylinder head of an engine, an external shoulder 18 for forming a flat or conical seat on the cylinder head, a hexagonal or installation section 40 for use with an assembly tool, and a closed end section 42 that is crimped or clamped onto the insulator 22.

The metal shell 12 can be composed of a number of types of steel or another suitable metal, and can also be coated with a zinc-based or a nickel-based alloy coating, to name one example. The threaded section 14 extends between the free end section and the external shoulder 18, and the threaded section can have external threads with a number of conventional diameters (e.g., M14, M12, M10, M8, etc.) as a function of the particular application for which the spark plug 10 is designed. The external shoulder 18 extends radially outward from the threaded section 14, and includes an annular shell seal surface. When the spark plug 10 is installed in a cylinder head by thread engagement, the sealing ring 20 is pressed together or compressed, namely between the shell seal surface and a corresponding seal surface of the cylinder head, creating an airtight seal that prevents exhaust gases from being blown out.

The hexagonal section 40 is designed to accept a socket, a wrench, or another installation or assembly tool so that the spark plug can be screwed into the cylinder head with a suitable torque. It is a matter of course that the materials and configurations mentioned are merely examples and that other designs, including of shells with shorter threaded sections (e.g., with shorter thread engagement lengths) can naturally be used instead.

The metal shell 12 has an inside shoulder 34 that is inclined inward at an angle, with which is associated a correspondingly inclined outside shoulder 36 of the insulator 22. Formed between the inside shoulder 34 of the metal shell 12 and the outside shoulder 36 of the insulator 22 is a gap that is filled by a sealing ring 38 in accordance with the invention.

The sealing ring 38 represents the inside seal of the spark plug 10, with which the spark plug is sealed in the region between insulator 22 and metal shell 12. It is a matter of course that other inner seals in addition to this sealing ring 38 can also be provided between insulator 22 and metal shell 12. As opposed to typical metal sealing rings, the polymer sealing ring 38 can entirely cover the external shoulder 36 of the insulator 22 and extend up through the bore between the insulator 22 and the metal shell 12 toward the terminal end of the spark plug 10. Complete coverage of the external shoulder of the insulator can provide for improved conformational sealing, which can minimize the escape of combustion gases from the combustion chamber. Also, complete coverage of the external shoulder 36 can help reduce radial movement of the insulator 22 in the shell 12, unlike insulators and seals that are only oriented axially with respect to the insulator and the shell. This may help reduce insulator breakage, as it could help restrict undesirable radial movement of the insulator 22 resulting from extreme force during combustion events.

According to the invention, the sealing ring 38, which seals the gap between the inside shoulder 34 of the metal shell 12 and the associated outside shoulder 36 of the insulator 22, is made of polyether ether ketone (PEEK), to which a filler of boron nitride and of glass fibers and/or carbon fibers has additionally been added.

The sealing ring 38 can have 5 to 80 percent by volume or 20 to 60 percent by volume boron nitride and 0 to 30 percent by volume, preferably 3 to 20 percent by volume, glass fibers and/or carbon fibers. For example, the sealing ring contains 40 percent by volume boron nitride and 10 percent by volume carbon fibers, with the remainder being composed of PEEK. Such a sealing ring 38 preferably has a thermal conductivity of at least 4 $Wm^{-1}K^{-1}$ and a dielectric strength of at least 20 kV/mm, preferably of approximately 23 kV/mm.

According to information from the manufacturer, the polyether ether ketone, PEEK, that is used has a dielectric strength of approximately 23 kV/mm and a melting point of 290 to 370° C. The density is in the range from 1.2 to 1.7 $g/cm^3$.

Described below on the basis of FIGS. 2 through 6 is a finite element analysis (FEA) that provides proof that the sealing ring according to one or more embodiments of the invention is suitable for practical use and brings about an improvement in the dielectric strength of the ignition electrode.

FIG. 2 shows a detail of a conventional spark plug with the thread M12, with the center electrode in the left-hand region, and the gap filled by the sealing ring in the right-hand region on the metal shell 12. In this case, a standard voltage of 1 V was applied to the center electrode for test purposes. As a result of the voltage drop at the spark plug, a voltage of only 0.831 V is measured at the center electrode in the region opposite the sealing ring. Because the conventional sealing ring is made of metal, and in this respect has no electrical insulating properties, a voltage of 0 V results at the sealing ring on the opposite side. The thickness of the sealing ring is 1.956 mm. The result is a maximum electric field strength of 3.056 V/mm.

FIG. 3 shows the result of the FEA under otherwise comparable conditions with the application of a voltage of 1 V to the center electrode. The sealing ring in this case is made of PEEK with a dielectric strength of 23 kV/mm. The result is a voltage of 0.847 V at the center electrode, and a voltage of 0.258 V at the sealing ring. Therefore, a voltage drop of 0.589 V is produced across the insulator.

Consequently, the resultant electric field is significantly lower, and, in the present case, has a maximum field strength of 0.675 V/mm. Accordingly, the result is a significantly increased dielectric strength.

FIG. 4 shows the component temperatures in the region of the threaded section of the cylinder head using the following data:

temperature at the outside gasket: 110° C.;

cylinder cooling temperature: 125° C.;

heat flux that acts on the interior surface of the cylinder, taking into account a specific power output of an engine of 110 kW/l. The diagram shows the temperatures along the threaded section in the cylinder head that the spark plug is screwed into.

Temperatures that result are in the range between 118° C. and 195° C.

Figure 1:
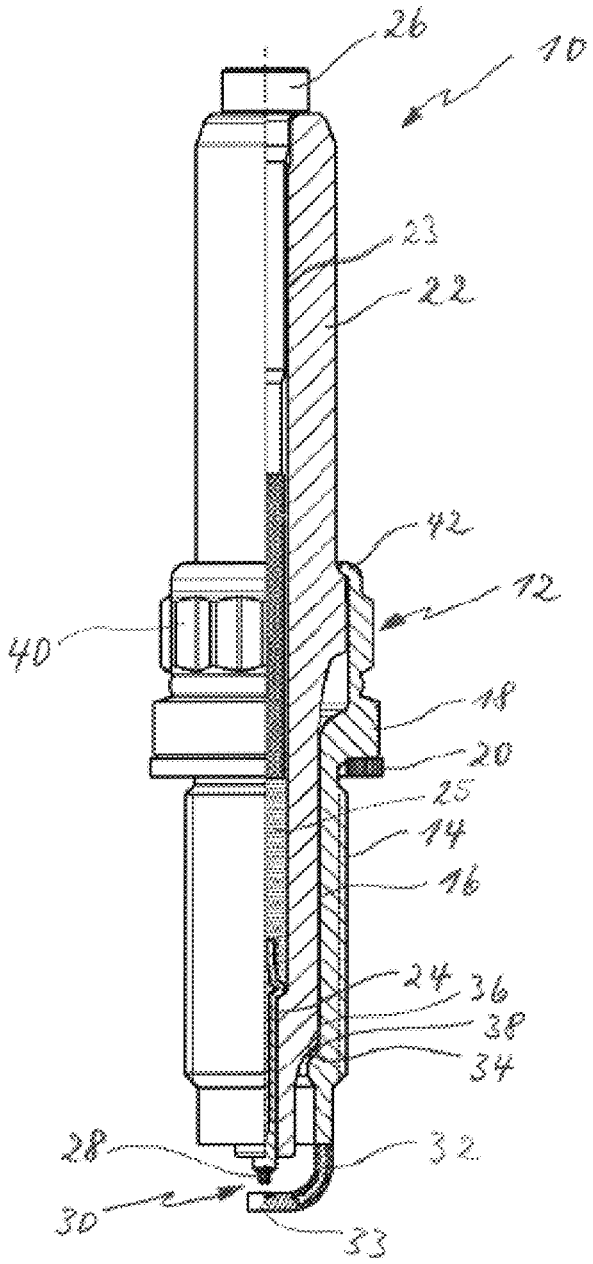
Figure 2:
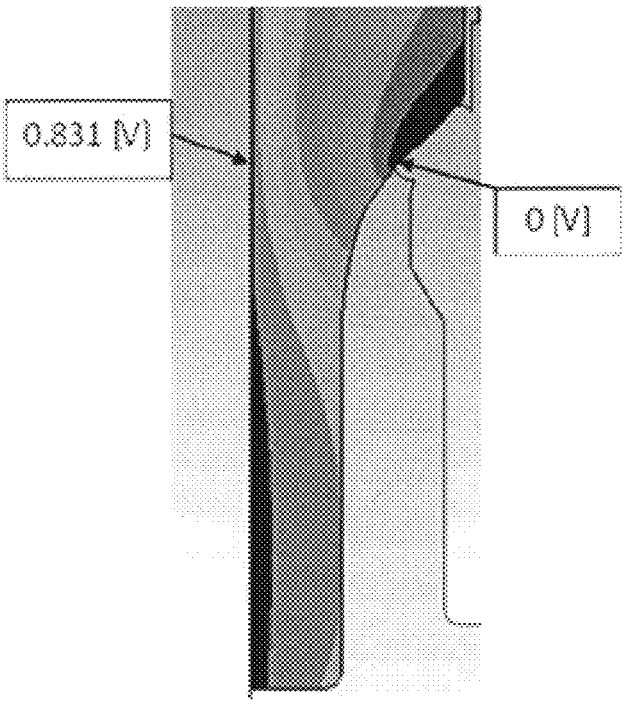
Figure 3:
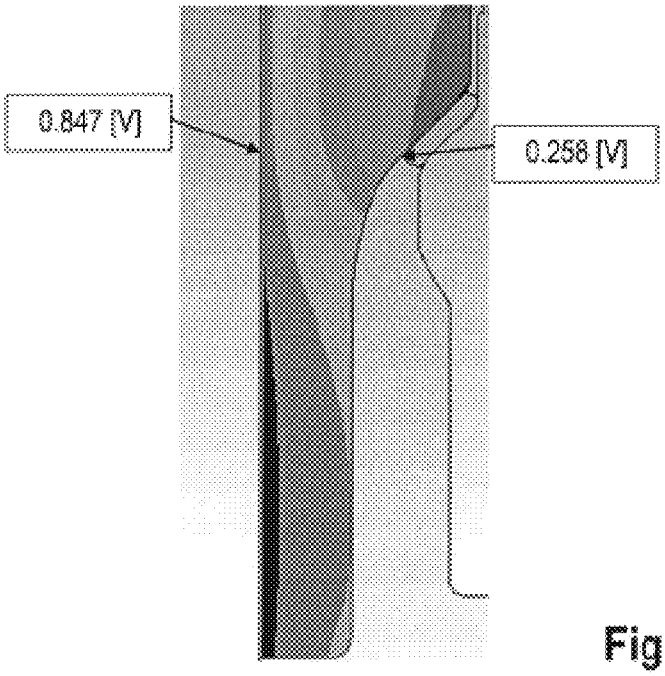
Figure 4:
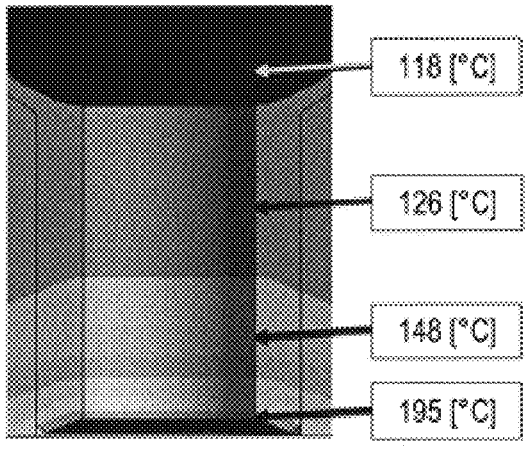
FIGS. 4 to 6 are used to explain that the thermal stress of the spark plug, in particular in the region of the sealing ring, is within the scope of permissible values.
Figure 5:
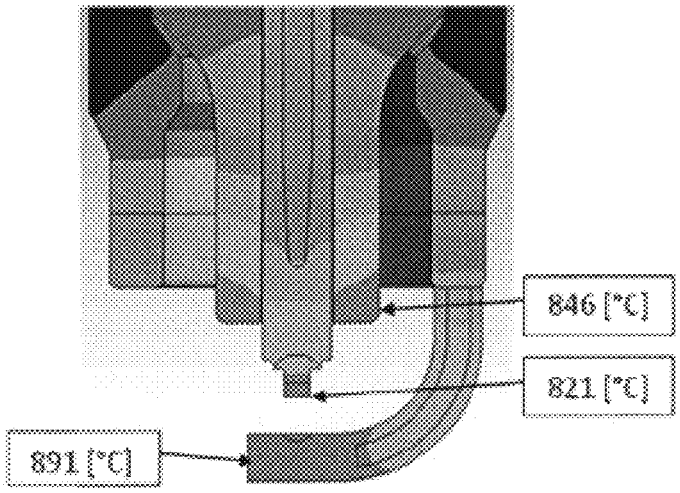

FIG. 5 shows the resulting temperatures for the standard spark plug from FIG. 2 with the sealing ring made of PEEK having a thermal conductivity of 4 $Wm^{-1}K^{-1}$ under full load conditions.

The temperatures of 821° C. at the end section 28 of the center electrode 24 and 891° C. at the opposite end section 33 of the ground electrode 32, as well as 846° C. at the end of the insulator 22, are in the permissible range.

Figure 6:
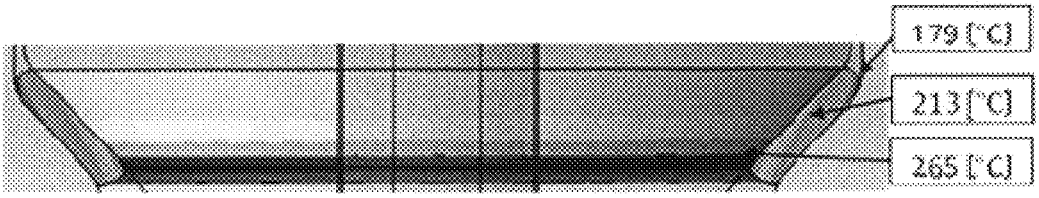

FIG. 6 shows the resulting temperatures in the vicinity of the sealing ring when the above-described parameters consisting of PEEK with a conductivity of 4 $Wm^{-1}K^{-1}$ are used.

The temperature at the end of the sealing ring 38 on the combustion-chamber side is 265° C., while the temperature at the other end is only 179° C. These temperatures are within the permissible range for PEEK, significantly below the maximum application temperature of 290° C.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug comprising:

a metal shell with an axial bore and a threaded section;

an insulator with an axial bore that is located at least partially inside the axial bore of the metal shell;

a center electrode that is accommodated at least partially inside the axial bore of the insulator;

a ground electrode that is held by the metal shell, wherein an end region of the ground electrode forms, together with an end region of the center electrode, an ignition gap, and a sealing ring that extends at least between an outside shoulder of the insulator and an inside shoulder of the metal shell, wherein the sealing ring has polyaryl ether ketone (PAEK).

2. The spark plug according to claim 1, in which the sealing ring has polyether ether ketone (PEEK).

3. The spark plug according to claim 1, in which the sealing ring extends at least in a gap that is formed between the outside shoulder of the insulator and the inside shoulder of the metal shell.

4. The spark plug according to claim 3, in which the sealing ring extends at least partially beyond the gap in a direction distant from the end region of the center electrode.

5. The spark plug according to claim 1, in which the sealing ring additionally has a filler.

6. The spark plug according to claim 5, in which the sealing ring has boron nitride as filler.

7. The spark plug according to claim 6, in which the sealing ring has 5 to 80 percent by volume boron nitride.

8. The spark plug according to claim 7, in which the sealing ring has 10 to 70 percent by volume boron nitride.

9. The spark plug according to claim 8, in which the sealing ring has 20 to 60 percent by volume boron nitride.

10. The spark plug according to claim 5, in which the sealing ring has glass fibers and/or carbon fibers as filler.

11. The spark plug according to claim 10, in which the sealing ring has 1 to 30 percent by volume glass fibers and/or carbon fibers.

12. The spark plug according to claim 11, in which the sealing ring has 3 to 25 percent by volume glass fibers and/or carbon fibers.

13. The spark plug according to claim 12, in which the sealing ring has 3 to 20 percent by volume glass fibers and/or carbon fibers.

14. The spark plug according to claim 1, in which the sealing ring has a thermal conductivity of at least 3 $Wm^{-1}K^{-1}$.

15. The spark plug according to claim 14, in which the sealing ring has a thermal conductivity of at least 3.5 $Wm^{-1}K^{-1}$.

16. The spark plug according to claim 15, in which the sealing ring has a thermal conductivity of at least 4 $Wm^{-1}K^{-1}$.

17. The spark plug according to claim 1, in which the sealing ring has a dielectric strength of at least 16 kV/mm.

18. The spark plug according to claim 17, in which the sealing ring has a dielectric strength of at least 18 kV/mm.

19. The spark plug according to claim 18, in which the sealing ring has a dielectric strength of at least 19 kV/mm.

20. The spark plug according to claim 19, in which the sealing ring has a dielectric strength of at least 20 kV/mm.

* * * * *